US011267275B2

(12) United States Patent
Okamoto et al.

(10) Patent No.: US 11,267,275 B2
(45) Date of Patent: Mar. 8, 2022

(54) BOOK BLOCK ALIGNING DEVICE

(71) Applicant: Horizon International Inc., Takashima (JP)

(72) Inventors: Kohei Okamoto, Takashima (JP); Shigenobu Fukuda, Takashima (JP); Shigeru Wakimoto, Takashima (JP)

(73) Assignee: Horizon International, Inc., Takashima (JP)

( * ) Notice: Subject to any disclaimer, the term of this patent is extended or adjusted under 35 U.S.C. 154(b) by 0 days.

(21) Appl. No.: 17/090,586

(22) Filed: Nov. 5, 2020

(65) Prior Publication Data

US 2021/0138821 A1 May 13, 2021

(30) Foreign Application Priority Data

Nov. 7, 2019 (JP) ..... JP2019-202139

(51) Int. Cl.
*B65H 31/38* (2006.01)
*B42C 1/00* (2006.01)

(52) U.S. Cl.
CPC ..... *B42C 1/00* (2013.01); *B65H 31/38* (2013.01); *B65H 2301/4212* (2013.01)

(58) Field of Classification Search
CPC .. B42C 1/00; B65H 31/38; B65H 2301/4212; B65H 2301/4222
USPC ..... 270/58.27
See application file for complete search history.

(56) References Cited

U.S. PATENT DOCUMENTS

| | | | | |
|---|---|---|---|---|
| 3,945,095 A * | 3/1976 | Herold | ..... | B65H 31/38 271/210 |
| 4,585,225 A * | 4/1986 | Miura | ..... | B65H 31/40 271/211 |
| 5,429,475 A | 7/1995 | Mohr | | |
| 6,626,430 B1 * | 9/2003 | Schmid | ..... | B65H 29/26 271/118 |
| 2002/0061238 A1 | 5/2002 | Marsh | | |

FOREIGN PATENT DOCUMENTS

| | | | | |
|---|---|---|---|---|
| EP | 0614840 A1 | 9/1994 | | |
| GB | 1329801 A * | 9/1973 | ..... | B65H 31/38 |
| JP | H0789258 A | 4/1995 | | |
| JP | 2004-001984 A | 1/2004 | | |
| JP | 2010-274501 A | 12/2010 | | |

OTHER PUBLICATIONS

Extended European search report dated Mar. 11, 2021 in corresponding application 20205464.9.

* cited by examiner

*Primary Examiner* — Leslie A Nicholson, III
(74) *Attorney, Agent, or Firm* — Muncy, Geissler, Olds & Lowe, P.C.

(57) ABSTRACT

Provided is a book block aligning device that forms one processing line with paper processing devices on an upstream side and a downstream side, and is capable of stably performing alignment processing of a book block at a high speed. Provided is the book block aligning device comprising an air blowing control mechanism that controls start/stop of blowing of air from an air outlet, and an air volume of air, in accordance with timing when a book block passes through the air outlet opened in a conveying surface provided in a conveying path, and a vibration mechanism that vibrates a first conveying surface.

10 Claims, 6 Drawing Sheets

BOOK BLOCK ALIGNING DEVICE

CROSS-REFERENCE TO RELATED APPLICATION

This application is based on Japanese Patent Application No. 2019-202139, filed on Nov. 7, 2019, the contents of which are incorporated herein by reference in its entirety.

TECHNICAL FIELD

The present disclosure relates to a book block aligning device that aligns a book block.

BACKGROUND

A bookbinding process may include accumulating sheets of paper to form a book block, aligning the book block, and then performing processing of bookbinding, cutting and the like.

For example, in perfect binding, sheets of paper sequentially discharged from a paper discharge device (a printer, a copier, a collator or the like) are accumulated in a paper accumulating section of the paper discharge device or by an accumulating device connected to a rear stage of the paper discharge device, to form a book block, and the book block in an aligned state is supplied to a clamper for a bookbinding machine. Then, the book block held with the clamper is conveyed between respective bookbinding processing units of the bookbinding machine by the clamper, and is bound as a book during the conveyance (e.g., see Japanese Unexamined Patent Application, Publication No. 2010-274501).

In this case, the sheets of paper discharged from the paper discharge device are charged with static electricity and are easy to stick to each other, and manual aligning of the book block is very inefficient. Therefore, the sheets of paper are usually accumulated to form the book block, and the book block is aligned by a book block aligning device and then supplied to the clamper for the bookbinding machine.

An example of a conventional book block aligning device is described in Japanese Unexamined Patent Application, Publication No. 2004-1984.

The book block aligning device described in Japanese Unexamined Patent Application, Publication No. 2004-1984 comprises an underframe, a support frame installed on the underframe, and a receiving frame provided on a front surface of an upper part of the support frame. The receiving frame forms two inclined face sections that incline and support orthogonal end faces of the book block, and a rear face section that faces a back surface of the book block.

Furthermore, the book block aligning device includes a vibrating means for vibrating the receiving frame, and a blowing means for blowing air from the inclined face sections of the receiving frame toward the end faces of the book block.

The vibrating means includes a vibration motor, and a rotary shaft of a drive motor is coupled to the rear face section of the receiving frame via an eccentric ring. The blowing means includes an air chamber formed on a back side of each inclined face section, a blower motor to supply air to the air chamber, and a blowing tube extending between the blower motor and the air chamber, and in the inclined face sections, a plurality of slit-shaped gas ports in communication with the air chamber are formed.

Furthermore, the underframe is provided with a foot switch, and the support frame is provided with an operation board. The operation board is provided with a changeover switch to change an operation of the book block aligning device to a manual operation or an automatic operation, a timer adjustment dial that sets an operation time of each means during the automatic operation, and an air volume adjustment dial.

Then, during the manual operation of the book block aligning device, all the vibrating means and blowing means operate in a state where the foot switch is turned on, while all the vibrating means and blowing means stop in a state where the foot switch is turned off.

The automatic operation of the book block aligning device includes two setting modes of a mode where all the vibrating means and blowing means operate only for a predetermined time, and a mode where the blowing means only operates only for a predetermined time.

Usually, the book block aligning device is manually operated. At this time, first, the book block is disposed in the receiving frame, and an air volume of air from the blowing means is adjusted in accordance with a size of a sheet of paper that forms the book block, a paper quality, a number of sheets, a sticking degree and the like. Afterward, an operator steps on the foot switch to start the operation of the book block aligning device, in which the air including ions is blown through the gas ports to the end faces of the book block while the receiving frame is vibrating. Consequently, the sheets of the book block are separated, and side surfaces of the book block are aligned. Afterward, the operator releases operator's foot from the foot switch to stop the operation of the book block aligning device.

However, in a case where this book block aligning device is used, it is necessary to place operators between the paper discharge device (or the paper accumulating device) and the book block aligning device, and between the book block aligning device and the bookbinding machine (the clamper) so that the book block is manually conveyed. Consequently, there has been a problem that production efficiency is very poor.

In this case, it is also considered that this conventional book block aligning device is connected to the paper discharge device (or the accumulating device) and the bookbinding machine via a conveying device, and the book block is transferred by using the conveying device.

However, if air blowing is started before the book block enters the paper bundle aligning device, the book block may be unexpectedly disturbed and may not be aligned well. On the other hand, there is time lag between switching on/off of the blowing means and switching start/stop of the air blowing. Therefore, if the blowing means is turned on during the entrance of the book block, and is then turned off, the book block is fanned only for a short time, thereby decreasing processing efficiency.

That is, only by switching on/off the blowing means and switching between air blowing by a constant volume and the stop of the air blowing, alignment processing of the book block cannot be stably performed at a high speed.

SUMMARY

An object of the present disclosure is therefore to provide a book block aligning device that forms one processing line with paper processing devices on an upstream side and a downstream side, and is capable of stably performing alignment processing of a book block at a high speed.

To solve the above-mentioned problems, the present disclosure employs the following solutions.

A book block aligning device according to one aspect of the present disclosure includes: an air blowing control mechanism that switches start and stop of blowing of air from at least one air outlet, in accordance with timing when a book block passes through the at least one air outlet opened in a conveying surface provided in a conveying path, and a vibration mechanism that vibrates the conveying surface of the conveying path.

The book block aligning device according to one aspect of the present disclosure may include: a frame including the conveying path, wherein the conveying path includes a first conveying surface inclined to support one surface of the book block, and a second conveying surface extending from a lower edge of the first conveying surface at right angles to the first conveying surface, and inclined to support one side surface of the book block, the book block aligning device further including: a conveying mechanism provided in the frame, to convey the book block along the conveying path, at least one blower provided in the frame, and connected to the at least one air outlet opened in the second conveying surface via at least one duct, and the vibration mechanism provided in the frame.

In the book block aligning device according to one aspect of the present disclosure, the air blowing control mechanism controls an air volume of air to be blown from the at least one air outlet, in accordance with timing when the book block passes through the at least one air outlet.

In the book block aligning device according to one aspect of the present disclosure, the air blowing control mechanism comprises a shutter plate disposed in the duct opposite to the at least one air outlet, and movable in a width direction or a length direction of the second conveying surface, the shutter plate comprises an opening, and the opening is formed to gradually change in area from one end side toward the other end side of the shutter plate in a moving direction, the air blowing control mechanism comprises at least one slide guide attached to the frame on an underside of the second conveying surface, and extending in parallel with the second conveying surface and in the width direction or the length direction of the second conveying surface, and the shutter plate is slidably attached to the at least one slide guide, and the air blowing control mechanism comprises a shutter plate drive mechanism provided in the frame, to slide and move the shutter plate from the one end side in the moving direction toward the other end side in the moving direction while the book block moves over the conveying path, the shutter plate being slid and moved from a first closing position where the shutter plate closes the at least one air outlet, through an opening position where the shutter plate opens the at least one air outlet, and gradually changes an opening area of the at least one air outlet, to a second closing position where the shutter plate closes the at least one air outlet.

In the book block aligning device according to one aspect of the present disclosure, the opening of the shutter plate is formed to gradually increase in area from the one end side toward the other end side of the shutter plate in the moving direction, and the shutter plate gradually opens the at least one air outlet at the opening position.

In the book block aligning device according to one aspect of the present disclosure, the shutter plate drive mechanism includes: a rack fixed to a lower surface of the shutter plate, and extending in parallel with the at least one slide guide, and a motor attached to the frame below the shutter plate, a drive shaft of the motor extends toward the shutter plate and vertically to the shutter plate, and the shutter plate drive mechanism includes a pinion fixed to the drive shaft of the motor and engaged with the rack.

In the book block aligning device according to one aspect of the present disclosure, the at least one air outlet comprises: a slit-shaped first air outlet extending in the width direction of the second conveying surface on an inlet side of the second conveying surface, and a slit-shaped second air outlet disposed in the conveying direction at an interval from an end of the first air outlet closer to the first conveying surface, and extending at right angles to the first air outlet toward an outlet of the second conveying surface.

In the book block aligning device according to one aspect of the present disclosure, the shutter plate is slidably movable in the width direction of the second conveying surface, the opening of the shutter plate includes:

a first aperture disposed in correspondence with the first air outlet, and a second aperture disposed in correspondence with the second air outlet, the first aperture extends in parallel with the first air outlet, and forms a slit shape having at least a length equal to a length of the first air outlet and at least a width equal to a width of the first air outlet, the first aperture is disposed to match the first air outlet in a length direction of the second conveying surface, the second aperture includes: a first aperture edge disposed on a straight line with an edge of the other end side of the first aperture in the moving direction, and extending along at least a length equal to a length of the second air outlet, a second aperture edge extending from an end of the first aperture edge closer to the first aperture, at right angles to the first aperture edge, from the other end side in the moving direction toward the one end side in the moving direction, and along a length smaller than a length of the first aperture, and a step-shaped third aperture edge connecting an end of the second aperture edge on the one end side in the moving direction and an end of the first aperture edge away from the first aperture, and the first aperture edge is disposed to match the second air outlet in the length direction of the second conveying surface.

The book block aligning device according to one aspect of the present disclosure may include: a butting alignment guide provided in the frame, to butt and align the book block in the conveying direction and/or a direction at right angles to the conveying direction.

According to the present disclosure, a book block in a tilted state is conveyed along a conveying path, and the book block can be aligned during the conveying and/or during stop of the conveying.

Then, the conveying path of a book block aligning device of the present disclosure extends, to connect the book block aligning device of the present disclosure to each of paper processing devices on an upstream side and a downstream side, and the book block is conveyed by using a conveying mechanism of the book block aligning device of the present disclosure. In this case, one processing line comprising the upstream-side paper processing device, the book block aligning device of the present disclosure and the downstream-side paper processing device can be easily constructed.

Furthermore, according to the present disclosure, start and stop of blowing of air from an air outlet are switched in a state where the conveying path (a conveying surface) is vibrated in accordance with timing when the book block passes through the air outlet, during an operation of the book block aligning device.

Additionally, the blowing of air from the air outlet is started when a leading edge of the book block reaches the air outlet. Afterward, if alignment processing of the book block is completed, the air blowing is stopped prior to start of discharge of the book block from the book block aligning device.

Consequently, the book block can be vibrated while appropriately fanning the book block, and the alignment processing of the book block can be reliably and stably performed.

DESCRIPTION OF THE EMBODIMENTS

Hereinafter, a configuration of the present disclosure will be described based on a preferable example, with reference to the accompanying drawings.

Figure 1A:
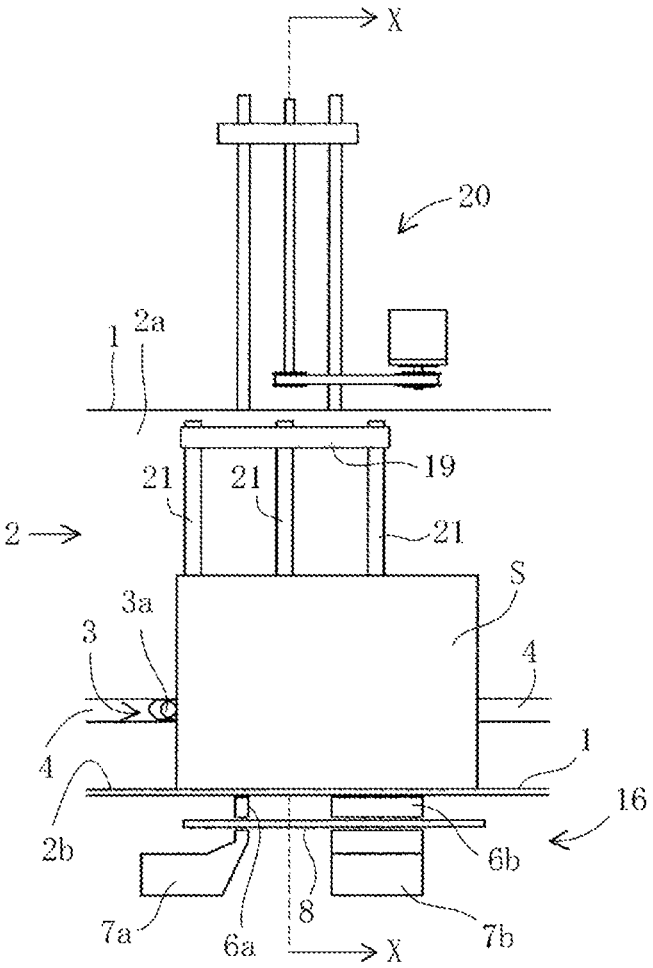
FIG. 1A is a front view showing a schematic configuration of a book block aligning device according to an example of the present disclosure.
Figure 1B:
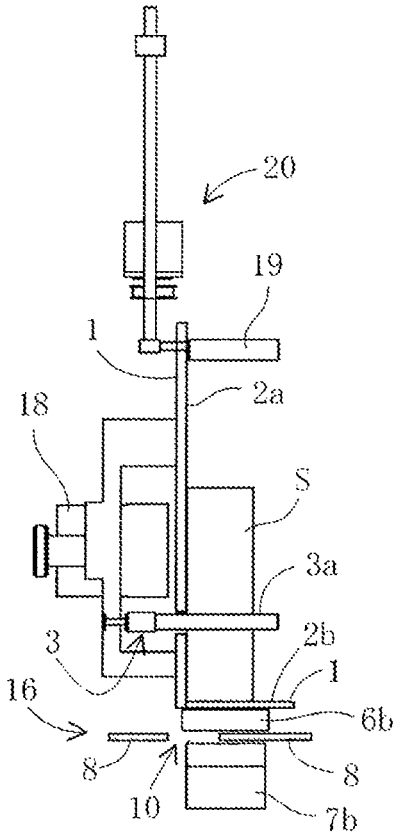
FIG. 1B is a side cross-sectional view taken along the X-X line of FIG. 1A showing a schematic configuration of a book block aligning device according to an example of the present disclosure.

FIG. 1A is a front view showing a schematic configuration of a book block aligning device according to an example of the present disclosure. FIG. 1B is a side cross-sectional view taken along the X-X line of FIG. 1A showing a schematic configuration of a book block aligning device according to an example of the present disclosure. Furthermore, FIG. 2 is a rear view of the book block aligning device of FIG. 1A, and FIG. 3 is a plan view of the book block aligning device of FIG. 1A seen in a direction along a first conveying surface of a conveying path.

Figure 2:
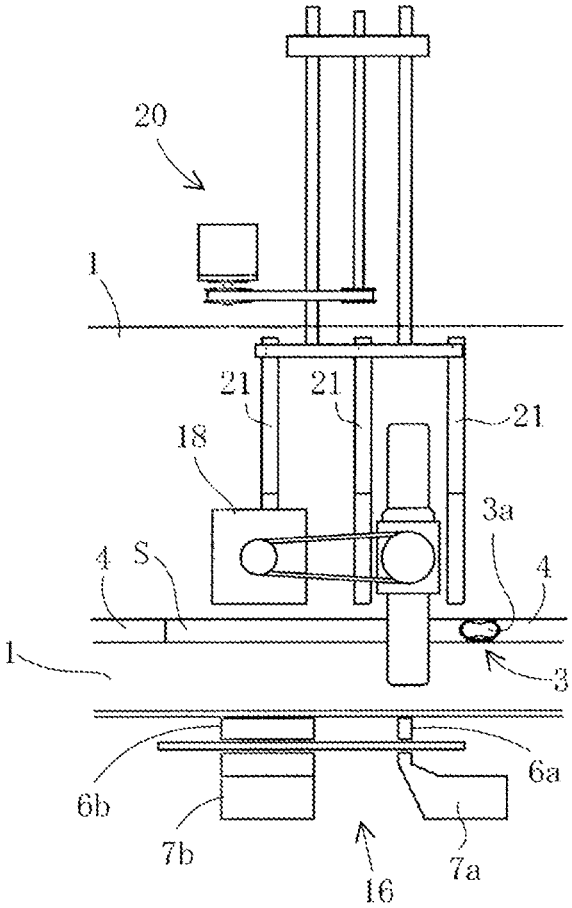
FIG. 2 is a rear view of the book block aligning device of FIG. 1A.
Figure 3:
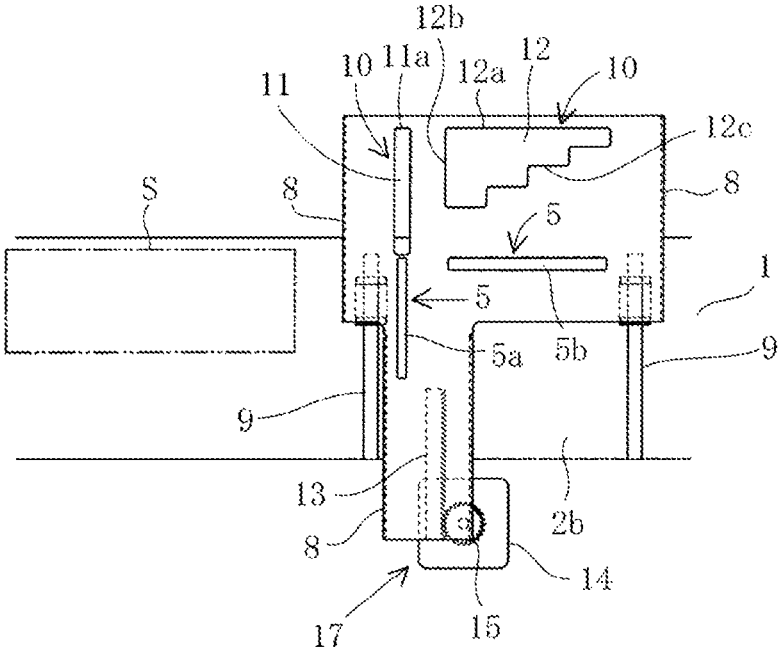
FIG. 3 is a plan view of the book block aligning device of FIG. 1A seen in a direction along a first conveying surface of a conveying path.

As shown in FIG. 1A, FIG. 1B and FIG. 2, the book block aligning device according to the present disclosure comprises a frame 1 including a conveying path 2 of a book block S.

The conveying path 2 comprises a first conveying surface 2*a* inclined to support one surface of the book block S, and a second conveying surface 2*b* extending from a lower edge of the first conveying surface 2*a* at right angles to the first conveying surface 2*a*, and inclined to support one side surface of the book block S.

Note that FIG. 1A and FIG. 2 are drawn as the front view and the rear view of the book block aligning device seen along the inclined second conveying surface 2*b* of the conveying path 2, respectively.

The book block aligning device of the present disclosure comprises a conveying mechanism 3 provided in the frame 1, to convey the book block S along the conveying path 2.

In this example, the conveying mechanism 3 comprises a pair of rotary shafts (not shown) extending in a width direction of the second conveying surface 2*b* at opposite ends of the conveying path 2, a sprocket (not shown) attached to each rotary shaft, an endless chain (not shown) disposed around a pair of sprockets, a plurality of conveying pins 3*a* attached to the endless chain and arranged at equal intervals in a length direction of the endless chain, and a drive mechanism (not shown) that drives one of the pair of rotary shafts.

Note that an interval between the conveying pins 3*a* adjacent to each other corresponds to a length of the conveying path 2.

In the first conveying surface 2*a*, a slit 4 extending in a conveying direction is formed, and each conveying pin 3*a* of the conveying mechanism 3 extends through the slit 4 to protrude onto the first conveying surface 2*a*.

Then, the endless chain is rotated and driven, and the conveying pin 3*a* pushes the book block S. Consequently, the book block S is conveyed along the conveying path 2.

As shown in FIG. 3, the second conveying surface 2*b* is provided with at least one air outlet 5.

In this example, the at least one air outlet 5 comprises a slit-shaped first air outlet 5*a* extending in the width direction of the second conveying surface 2*b* on an inlet side of the second conveying surface 2*b*, and a slit-shaped second air outlet 5*b* disposed in the conveying direction at an interval from an end of the first air outlet 5*a* closer to the first conveying surface 2*a*, and extending at right angles to the first air outlet 5*a* toward an outlet of the second conveying surface 2*b*.

The book block aligning device of the present disclosure also comprises blowers 7*a*, 7*b* provided in the frame 1, and connected to the first and second air outlets 5*a*, 5*b* via ducts 6*a*, 6*b*.

In the ducts 6*a*, 6*b*, a shutter plate 8 movable in the width direction of the second conveying surface 2*b* is disposed to face the first and second air outlets 5*a*, 5*b*.

Furthermore, a pair of parallel slide guides 9, 9 is attached to the frame on an underside of the second conveying surface 2*b*, and extends in parallel with the second conveying surface 2*b* and in the width direction of the second conveying surface 2*b*. Then, the shutter plate 8 is slidably attached to the pair of slide guides 9, 9.

The shutter plate 8 includes an opening 10. The opening 10 comprises a first aperture 11 disposed in correspondence with the first air outlet 5*a*, and a second aperture 12 disposed in correspondence with the second air outlet 5*b*.

The first aperture 11 extends in parallel with the first air outlet 5*a*, and forms a slit shape having a length equal to a length of the first air outlet 5*a* and a width slightly larger than a width of the first air outlet 5*a*. Then, the first aperture 11 is disposed to match the first air outlet 5*a* in a length direction of the second conveying surface 2*b*.

The second aperture 12 includes a first aperture edge 12*a* disposed on a straight line with an edge 11*a* of the first aperture 11 closer to the first conveying surface 2*a*, and extending along a length equal to a length of the second air outlet 5*b*, a second aperture edge 12*b* extending from an end of the first aperture edge 12*a* closer to the first aperture 11 in a direction at right angles to the first aperture edge 12*a* and away from the first conveying surface 2*a*, and extending along a length smaller than a length of the first aperture 11, and a step-shaped third aperture edge 12*c* connecting an end of the second aperture edge 12*b* away from the first conveying surface 2*a* and an end of the first aperture edge 12*a* away from the first aperture 11.

Furthermore, the first aperture edge 12*a* is disposed to match the second air outlet 5*b* in the length direction of the second conveying surface 2*b*.

A rack 13 is fixed to a lower surface of the shutter plate 8, and extends in parallel with the pair of slide guides 9, 9. Furthermore, a motor 14 is attached to the frame below the shutter plate 8. A drive shaft of the motor 14 extends toward the shutter plate 8 and vertically to the shutter plate 8.

Furthermore, a pinion 15 is fixed to the drive shaft of the motor 14, and the pinion 15 is engaged with the rack 13.

Additionally, the motor 14 rotates forward and backward, and the shutter plate 8 accordingly slides and moves to reciprocate along the pair of slide guides 9, 9.

The rack 13, the motor 14 and the pinion 15 form a shutter plate drive mechanism 17 that slides and moves the shutter plate 8.

FIG. 4 is a view similar to FIG. 3, for illustration of an operation of the shutter plate 8.

As shown in FIG. 4, the shutter plate 8 is driven by the shutter plate drive mechanism 17 to slide and move from an end side opposite to the first conveying surface 2*a* toward an end side closer to the first conveying surface 2*a* while the book block S passes through the air outlet 5, and specifically from a first closing position where the shutter plate 8 closes the air outlet 5, through an opening position where the shutter plate 8 gradually opens the air outlet 5, to a second closing position where the shutter plate closes the air outlet 5.

The shutter plate 8, the opening 10 of the shutter plate 8, the slide guide 9 and the shutter plate drive mechanism 17 form an air blowing control mechanism 16 that controls start/stop of blowing of air from the air outlet 5, and an air volume of air, in accordance with timing when the book block S passes through the air outlet 5.

The book block aligning device of the present disclosure further comprises a vibration mechanism 18 provided in the frame 1, to vibrate the first conveying surface 2*a* of the conveying path 2, and a butting alignment guide 19 provided in the frame 1, to butt and align the book block S in a direction at right angles to the conveying direction.

The butting alignment guide 19 extends in the conveying direction on the first conveying surface 2*a* of the conveying path 2, and a guide movement mechanism 20 is disposed on a back side of the first conveying surface 2*a*, and attached to the frame 1. Furthermore, in the first conveying surface 2*a*, a plurality of slits 21 extending in a width direction of the first conveying surface 2*a* are provided, and the butting alignment guide 19 is fixed to a tip of a linear actuator that protrudes from the slits 21 and moves in the width direction of the first conveying surface 2*a* in the guide movement mechanism 20.

Furthermore, a position of the butting alignment guide 19 is adjusted in advance, in accordance with a height of the book block S to be processed.

Next, an operation of the book block aligning device of the present disclosure will be described.

During the operation of the book block aligning device, the vibration mechanism 18 is continuously operated, to always vibrate the conveying path 2 and the butting alignment guide 19. On the other hand, the blowers 7*a*, 7*b* are continuously operated during the operation of the book block aligning device, but the shutter plate 8 is present at the first closing position until the book block S reaches the air outlet 5, and hence any air is not blown from the air outlet 5.

Figure 4A:
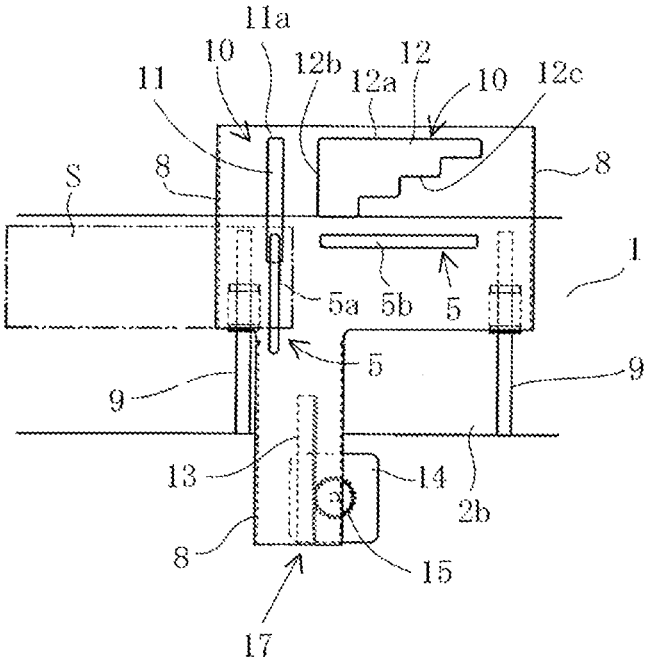
FIG. 4A is a view similar to FIG. 3, for illustration of an operation of a shutter plate of the book block aligning device of FIG. 1A.
Figure 4B:
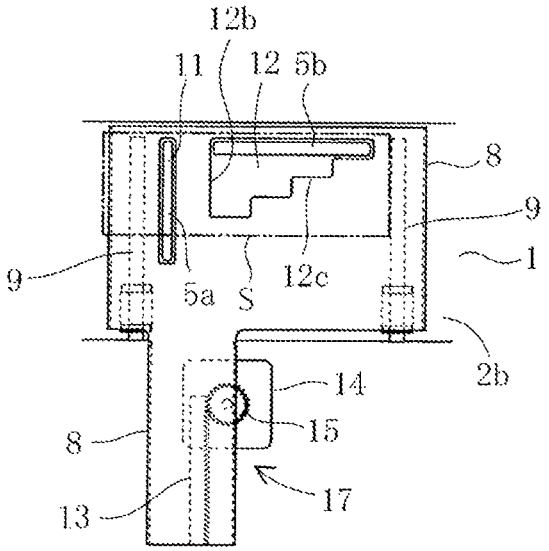
FIG. 4B is a view similar to FIG. 3, for illustration of an operation of a shutter plate of the book block aligning device of FIG. 1A.

The book block S is conveyed in a tilted state on the conveying path 2 by the conveying mechanism 3 (the conveying pin 3*a*), and when a leading edge of the book block S reaches the first air outlet 5*a* as shown in FIG. 4(A), the shutter plate 8 moves to the opening position, where air starts to be blown from the first air outlet 5*a* (at this time, the second air outlet 5*b* is still closed).

Afterward, an opening area of the first air outlet 5*a* gradually increases until the leading edge of the book block S reaches the second air outlet 5*b*, and accordingly, an air volume of air to be blown gradually increases.

When the leading edge of the book block S reaches the second air outlet 5*b*, air continues to be blown from the first air outlet 5*a*, and air starts to be blown from the second air outlet 5*b*. Afterward, as the conveying of the book block S proceeds, the air volume of air to be blown from the first air outlet 5*a* gradually increases, and the air volume of air to be blown from the second air outlet 5*b* gradually increases (see FIG. 4(B)).

Then, after alignment processing of the book block S is completed, the shutter plate 8 moves from the opening position to the second closing position, to stop the blowing of air from the air outlet 5, prior to start of discharge of the book block S from the book block aligning device.

Thus, according to the present disclosure, the book block S in the tilted state is conveyed along the conveying path 2, and the book block S can be aligned during the conveying and/or during the stop of the conveying.

Then, the conveying path 2 of the book block aligning device of the present disclosure extends, to connect the book block aligning device to each of paper processing devices on an upstream side and a downstream side, and the book block S is conveyed by using the conveying mechanism 3 of the book block aligning device. In this case, one processing line comprising the upstream-side paper processing device, the book block aligning device and the downstream-side paper processing device can be easily constructed.

Furthermore, according to the present disclosure, the start/stop of the blowing of air from the air outlet 5 and the air volume of air are controlled in a state where the conveying path 2 and the butting alignment guide 19 are vibrated, in accordance with the timing when the book block S passes through the air outlet 5, during the operation of the book block aligning device.

Additionally, the blowing of air from the air outlet 5 is started in accordance with timing when the book block S enters the air outlet 5, and the air volume of air is gradually increased while the book block S passes through the air outlet 5. Afterward, when the alignment processing of the book block S is completed, the blowing of air is stopped prior to the start of the discharge of the book block S from the book block aligning device.

Consequently, the book block S can be reliably and stably aligned.

As above, the preferable example of the present disclosure has been described, but the configuration of the present invention is not limited to the above example. Needless to say, a person skilled in the art can come up with various modifications within the scope of the configuration defined in the appended claims.

For example, the configuration of the air outlet 5 is not limited to the above example, and may be appropriately determined in view of sizes (longitudinal and lateral sizes, and a thickness) of the book block S, paper quality of paper, or the like so that the book block S can be efficiently and stably fanned.

Also, the configuration of the opening 10 of the shutter plate 8 is not limited to the above example. Furthermore, the opening 10 may be appropriately formed in any configuration, as long as an area of the opening gradually changes from one end side toward the other end side of the shutter plate 8 in a moving direction, and the shutter plate 8 is slidably movable from the one end side toward the other end side, specifically from the first closing position where the shutter plate 8 closes the air outlet 5, through the opening position where the shutter plate 8 opens the air outlet 5 and an opening area of the air outlet is gradually changed, to the second closing position where the shutter plate closes the air outlet 5.

Therefore, for example, the opening 10 of the shutter plate 8 may be formed in a configuration where an area of the opening gradually increases from one end side toward the other end side of the shutter plate 8 in the moving direction, and then decreases, and at the opening position at which the shutter plate 8 opens the air outlet 5, the opening area of the air outlet 5 gradually increases, and then gradually decreases.

In the above example, the shutter plate 8 is moved in the width direction of the second conveying surface 2*b* of the conveying path 2. Alternatively, the shutter plate 8 may be moved in the length direction of the second conveying surface 2*b* of the conveying path 2.

Also, the configuration of the shutter plate drive mechanism 17 is not limited to the above example, and the shutter plate drive mechanism 17 may comprise, for example, a ball screw and a motor.

In the above example, the shutter plate 8 is used as the air blowing control mechanism 16, but the air blowing control mechanism 16 may comprise one or more valves.

In this case, the air blowing control mechanism 16 can be not only configured to control the start/stop of the blowing of air from the air outlet 5, and the air volume of air, in accordance with the timing when the book block S passes through the air outlet 5, but also the air blowing control mechanism 16 may be configured only to switch the start and stop of the blowing of air from the air outlet 5, in accordance with the timing when the book block S passes through the air outlet 5.

In the latter case, the blowing of air from the air outlet 5 starts when the leading edge of the book block S reaches the air outlet 5, and afterward when the alignment processing of the book block S is completed, the blowing of air is stopped prior to the start of the discharge of the book block S from the book block aligning device.

Furthermore, in place of or in addition to the butting alignment guide 19 that aligns the book block S in the conveying direction, a butting alignment guide that aligns the book block S in a direction at right angles to the conveying direction may be provided.

What is claimed is:

1. A book block aligning device comprising:

a conveying mechanism that conveys a book block along a conveying path, an air blowing control mechanism that switches start and stop of blowing of air from at least one air outlet, in accordance with timing when the book block passes through the at least one air outlet opened in a paper conveying surface provided in the conveying path, and a vibration mechanism that vibrates the paper conveying surface of the conveying path, wherein the air blowing control mechanism starts the blowing of air from the air outlet when a leading edge of the book block conveyed by the conveying mechanism reaches the air outlet.

2. The book block aligning device according to claim 1, further comprising: a frame including the conveying path, wherein the paper conveying surface includes a first conveying surface to support one surface of the book block, and a second conveying surface extending from a lower edge of the first conveying surface, and to support one side surface of the book block, the book block aligning device further comprising: at least one blower provided in the frame, and connected to the at least one air outlet opened in the second conveying surface via at least one duct, and the vibration mechanism provided in the frame.

3. The book block aligning device according to claim 2, wherein the air blowing control mechanism controls an air volume of air to be blown from the at least one air outlet, in accordance with timing when the book block passes through the at least one air outlet.

4. The book block aligning device according to claim 2, further comprising a butting alignment guide provided in the frame, to butt and align the book block in the conveying direction and/or a direction at right angles to the conveying direction.

5. The book block aligning device according to claim 1, wherein the air blowing control mechanism stops the blowing of air from the air outlet prior to start of discharge of the book block from the book block aligning device.

6. A book block aligning device comprising:

a conveying mechanism that conveys a book block along a conveying path, an air blowing control mechanism that switches start and stop of blowing of air from at least one air outlet, in accordance with timing when the book block passes through the at least one air outlet opened in a paper conveying surface provided in the conveying path, and a vibration mechanism that vibrates the paper conveying surface of the conveying path, wherein the air blowing control mechanism controls an air volume of air to be blown from the at least one air outlet, in accordance with timing when the book block passes through the at least one air outlet, wherein the air blowing control mechanism comprises a shutter plate disposed in the duct opposite to the at least one air outlet, and movable in a width direction or a length direction of the second conveying surface, the shutter plate comprises an opening, and the opening is formed to gradually change in area from one end side toward the other end side of the shutter plate in a moving direction, wherein the air blowing control mechanism comprises at least one slide guide attached to the frame on an underside of the second conveying surface, and extending in parallel with the second conveying surface and in the width direction or the length direction of the second conveying surface, and the shutter plate is slidably attached to the at least one slide guide, and wherein the air blowing control mechanism comprises a shutter plate drive mechanism provided in the frame, to slide and move the shutter plate from the one end side in the moving direction toward the other end side in the moving direction while the book block moves over the conveying path, the shutter plate being slid and moved from a first closing position where the shutter plate closes the at least one air outlet, through an opening position where the shutter plate opens the at least one air outlet, and gradually changes an opening area of the at least one air outlet, to a second closing position where the shutter plate closes the at least one air outlet.

7. The book block aligning device according to claim 6, wherein the opening of the shutter plate is formed to gradually increase in area from the one end side toward the other end side of the shutter plate in the moving direction, and the shutter plate gradually opens the at least one air outlet at the opening position.

8. The book block aligning device according to claim 6, wherein the shutter plate drive mechanism includes:

a rack fixed to a lower surface of the shutter plate, and extending in parallel with the at least one slide guide, and a motor attached to the frame below the shutter plate, a drive shaft of the motor extends toward the shutter plate and vertically to the shutter plate, and the shutter plate drive mechanism includes a pinion fixed to the drive shaft of the motor and engaged with the rack.

9. The book block aligning device according to claim 6, wherein the at least one air outlet comprises:

a slit-shaped first air outlet extending in the width direction of the second conveying surface on an inlet side of the second conveying surface, and a slit-shaped second air outlet disposed in the conveying direction at an interval from an end of the first air outlet closer to the first conveying surface, and extending at right angles to the first air outlet toward an outlet of the second conveying surface.

10. The book block aligning device according to claim 9, wherein the shutter plate is slidably movable in the width direction of the second conveying surface, the opening of the shutter plate includes:

a first aperture disposed in correspondence with the first air outlet, and a second aperture disposed in correspondence with the second air outlet, the first aperture extends in parallel with the first air outlet, and forms a slit shape having at least a length equal to a length of the first air outlet and at least a width equal to a width of the first air outlet, the first aperture is disposed to match the first air outlet in a length direction of the second conveying surface, the second aperture includes:

a first aperture edge disposed on a straight line with an edge of the other end side of the first aperture in the moving direction, and extending along at least a length equal to a length of the second air outlet, a second aperture edge extending from an end of the first aperture edge closer to the first aperture, at right angles to the first aperture edge, from the other end side in the moving direction toward the one end side in the moving direction, and along a length smaller than a length of the first aperture, and a step-shaped third aperture edge connecting an end of the second aperture edge on the one end side in the moving direction and an end of the first aperture edge away from the first aperture, and the first aperture edge is disposed to match the second air outlet in the length direction of the second conveying surface.

* * * * *